United States Patent [19]

Coulson

[11] Patent Number: 4,735,121

[45] Date of Patent: Apr. 5, 1988

[54] ADJUSTABLE WRENCH

[76] Inventor: Leonard Coulson, 99 Washington Ave., Kearny, N.J. 07032

[21] Appl. No.: 939,524

[22] Filed: Dec. 8, 1986

Related U.S. Application Data

[63] Continuation-in-part of Ser. No. 859,388, May 5, 1986, abandoned.

[51] Int. Cl.[4] ..... B25B 13/12

[52] U.S. Cl. ..... 81/129; 81/129.5; 81/135

[58] Field of Search ..... 81/135, 145, 134, 129.5, 81/129, 424.5, 186

[56] References Cited

U.S. PATENT DOCUMENTS

| | | | |
|---|---|---|---|
| 1,407,528 | 2/1922 | Gordon | 81/135 |
| 3,955,450 | 5/1976 | Evans | 81/170 |
| 4,513,645 | 4/1985 | Grabovac et al. | 81/57.39 |

*Primary Examiner*—Frederick R. Schmidt
*Assistant Examiner*—Maurina Rachuba
*Attorney, Agent, or Firm*—Samuelson & Jacob

[57] ABSTRACT

An adjustable wrench in which a slidable jaw is biased away from a fixed jaw, toward a fully-open position, by the force of a biasing spring, and a pawl and ratchet mechanism locks the slidable jaw, against the biasing force of the biasing spring, in any selected one of a plurality of positions relative to the fixed jaw and enables selective release of the slidable jaw for movement to the fully-open position in response to the biasing force of the biasing spring.

14 Claims, 2 Drawing Sheets

ADJUSTABLE WRENCH

This is a continuation-in-part application Ser. No. 859,388 filed May 5, 1986 now abandoned.

The present invention relates generally to the wrenching of fastener elements and pertains, more specifically, to a wrench having a wrenching configuration selectively adjustable to match the wrenching dimensions of any selected one of a variety of fastener elements having wrenching configurations of different wrenching dimensions.

The art of wrenching is replete with all manner of wrenches, each having the objective of performing a wrenching operation in yet a further improved fashion over earlier wrenches. Among these wrenches is the adjustable wrench which seeks to provide a single wrench for use in connection with fastener elements of differing dimensions, thereby achieving both convenience and economy. However, adjustable wrenches have exhibited several drawbacks. Thus, in a quest for ease of adjustment and use, accuracy of the wrenching configuration of the wrench has suffered. Likewise, economy dictates less complex arrangements of fewer component parts, but such arrangements have sacrificed wrenching performance. Of all of the proposed adjustable wrench arrangements, one which has emerged as a popular choice is the type having a sliding jaw movable relative to an opposed fixed jaw, enabling adjustment of the distance between the opposed jaws to match the wrenching dimension of a particular fastener element.

It is an object of the present invention to provide an adjustable wrench of the type described and in which adjustment is simplified and accomplished readily under a variety of wrenching conditions.

Another object of the invention is to provide an adjustable wrench of the type described and in which accurate adjustment is attained in a more positive fashion and accuracy is maintained during use.

Still another object of the invention is to provide an adjustable wrench of the type described and which is selectively disengaged, as well as engaged, with increased ease.

Yet another object of the invention is to provide an adjustable wrench of the type described and which has a simplified arrangement including fewer component parts of limited complexity, enabling simple yet rugged construction for economy of manufacture and an extended service life.

The above objects, as well as still further objects and advantages, are attained by the present invention which may be described briefly as a wrench having a wrenching configuration adjustable to match a wrenching dimension of any selected one of a variety of fastener elements having wrenching configuraations of different wrenching dimensions, the wrench comprising: a wrenching head; opposed jaws on the wrenching head and having wrenching faces, at least one of the opposed jaws being mounted upon the wrenching head for sliding movement toward and away from another of the opposed jaws for respectively decreasing and increasing the spacing between the wrenching faces of the opposed jaws; biasing means continuously biasing the one jaw in the direction away from the other jaw; locking means carried by the wrenching head for locking the one jaw against the bias of the biasing means upon movement of the one jaw in the direction toward the other jaw to match the spacing between the wrenching faces with one of the different wrenching dimensions; and release means on the wrenching head for selectively releasing the locking means to permit movement of the one jaw in the direction away from the other jaw in response to the biasing means.

The invention will be understood more fully, while additional objectives, features and advantages will become apparent, in the following detailed description of embodiments of the invention illustrated in the accompanying drawing, in which.

Figure 1:
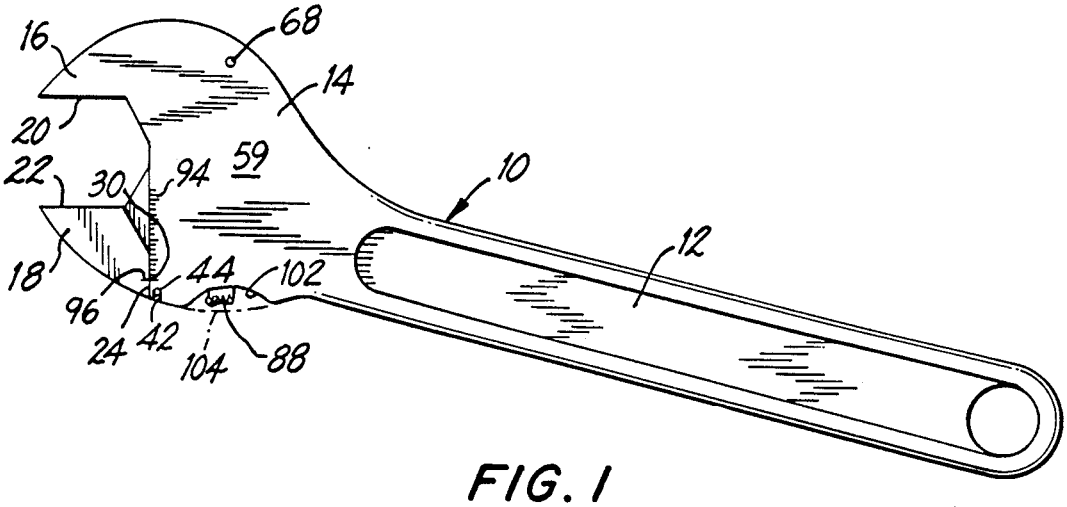
FIG. 1 is an elevational view of a wrench constructed in accordance with the invention.

Referring now to the drawing, and especially to FIG. 1 thereof, a wrench constructed in accordance with the invention is illustrated at 10. Wrench 10 has an elongate wrenching handle 12 extending between opposite ends, and a wrenching head 14 located at the forward one of the opposite ends of the handle 12. Wrenching head 14 includes opposed jaws 16 and 18, the jaws 16 and 18 providing opposed wrenching faces 20 and 22 projecting in a forward direction for engaging a fastener element for wrenching, in a manner to be explained in detail hereinafter.

Figure 2:
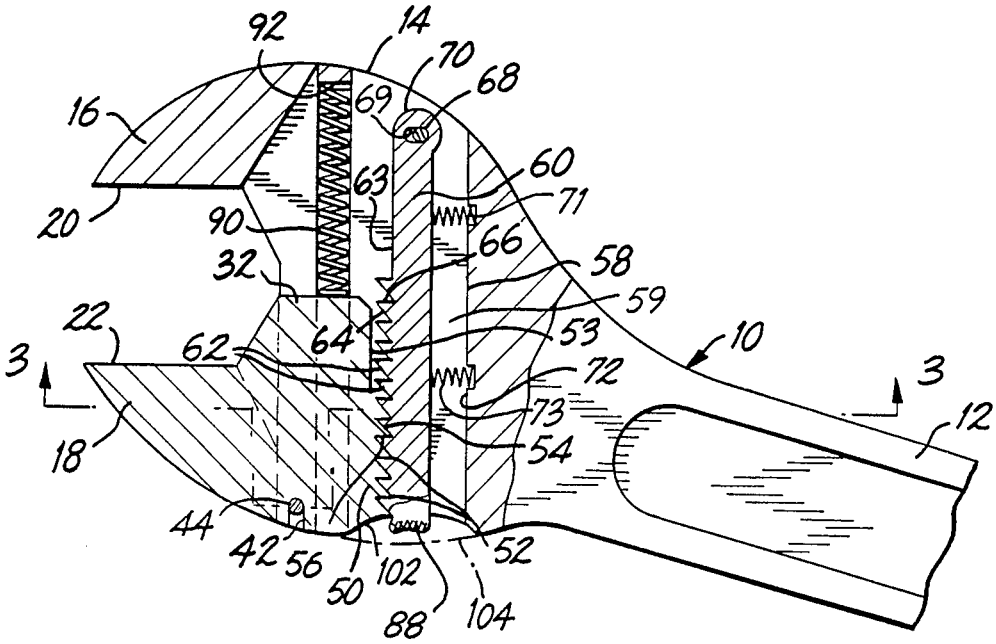
FIG. 2 is an enlarged fragmentary view, partially sectioned, of a portion of the wrench including the wrenching head.
Figure 3:
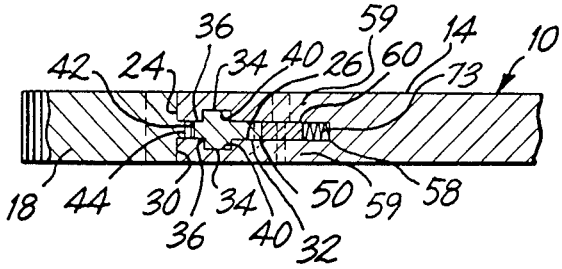
FIG. 3 is a cross-sectional view taken along line 3—3 of FIG. 2.

As best seen in FIGS. 2 and 3, as well as in FIG. 1, jaw 16 is unitary with wrenching head 14 and handle 12, while jaw 18 is mounted within wrenching head 14 for sliding movement relative to jaw 16. Thus, wrenching head 14 includes a guideway 24 and a groove 26 extending inwardly from guideway 24 into wrenching head 14. Jaw 18 has a shoulder 30, which engages guideway 24 for sliding movement along the guideway 24, and a tongue 32 which enters groove 26. A key 34 projects laterally from each side 36 of tongue 32 along the longitudinal extent of tongue 32, and each key 34 enters a complementary keyway 40 in the groove 26 of wrenching head 14 so that jaw 18 is guided for linear sliding movement toward and away from jaw 16. A slot 42 is placed adjacent the lowermost end of tongue 32 and a pin 44, secured to wrenching head 14, engages slot 42 to limit the extent of movement of jaw 18 relative to jaw 16, for purposes which will be explained below.

Tongue 32 carries a ratchet 50 having a plurality of ratchet teeth 52 spaced along rearward edge 53 of tongue 32; in this instance, the number of ratchet teeth 52 being six. Each ratchet tooth 52 includes a sloping face 54 facing upwardly, toward opposed jaw 16, and a locking face 56 facing downwardly, away from opposed jaw 16. Groove 26 extends inwardly beyond rearward edge 53 of tongue 32 and provides a cavity 58 having opposite sides enclosed by opposite side walls 59 of wrenching head 14, within which cavity 58 there is located a pawl 60 carrying a plurality of pawl teeth 62 along a forward edge 63; in this instance, the number of pawl teeth 62 being twelve. Each pawl tooth 62 includes a sloping face 64 facing downwardly and a locking face 66 facing upwardly and is complementary with each ratchet tooth 50. Pawl 60 is mounted for movement relative to wrenching head 14 by a pivot pin 68 anchored within wrenching head 14 and passing through a laterally elongate slot 69 in pawl 60 adjacent the upper end 70 thereof. An upper helical spring 71 and a lower helical spring 73 extend between the pawl 60 and the rear wall 72 of cavity 58 and bias the pawl 60 in a forward direction, to the left as viewed in FIG. 2, so as to urge pawl teeth 62 into engagement with ratchet teeth 52. In this manner, pawl 60 serves as a locking means to lock jaw 18 in a selected position relative to jaw 16.

Figure 4:
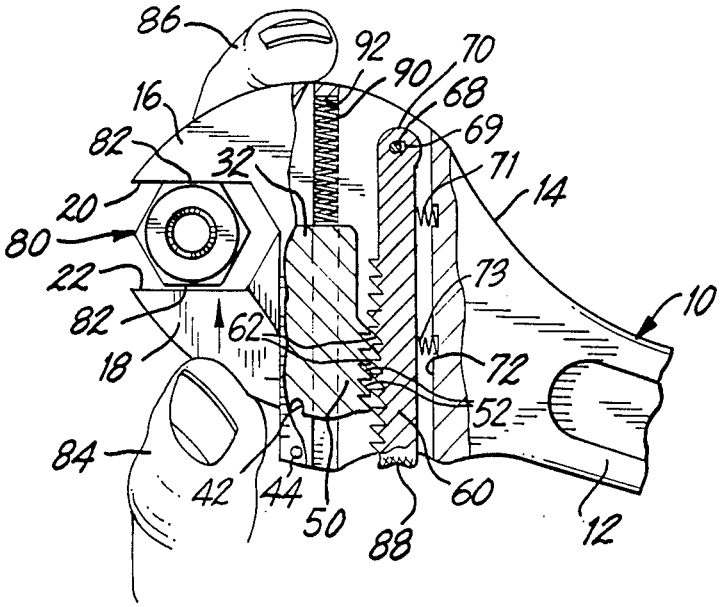
FIG. 4 is a view similar to FIG. 2, but with the component parts shown being applied to a fastener element for wrenching.

As depicted in FIGS. 1 and 2, wrenching head 14 of wrench 10 is in condition to receive, between jaws 16 and 18, a fastener element having a wrenching configuration including opposite wrenching faces spaced apart by any one of a plurality of wrenching dimensions, up to a maximum dimension defined by the maximum spacing between jaws 16 and 18, as shown. Turning now to FIG. 4, a fastener element shown in the form of a conventional hexagonal nut 80 is to be wrenched with wrench 10. Hexagonal nut 80 has opposite wrenching faces 82 which are to be engaged by the complementary corresponding wrenching faces 20 and 22 of jaws 16 and 18. Since the wrenching dimensions of nut 80 are less than the maximum spacing available between wrenching faces 20 and 22, jaw 18 is moved upwardly toward jaw 16 until the appropriate wrenching engagement is achieved. As seen in FIG. 4, the adjustment is made quite readily by an operator who merely pushes his thumb 84 against jaw 18, while bracing a finger 86 along wrenching head 14, adjacent jaw 16. Jaw 18 slides upwardly readily as the ratchet teeth 52 pass over pawl teeth 62 until the appropriate wrenching dimension is reached. At that point, pawl 60 locks jaw 18 in place and the wrenching dimension is held firm.

Figure 5:
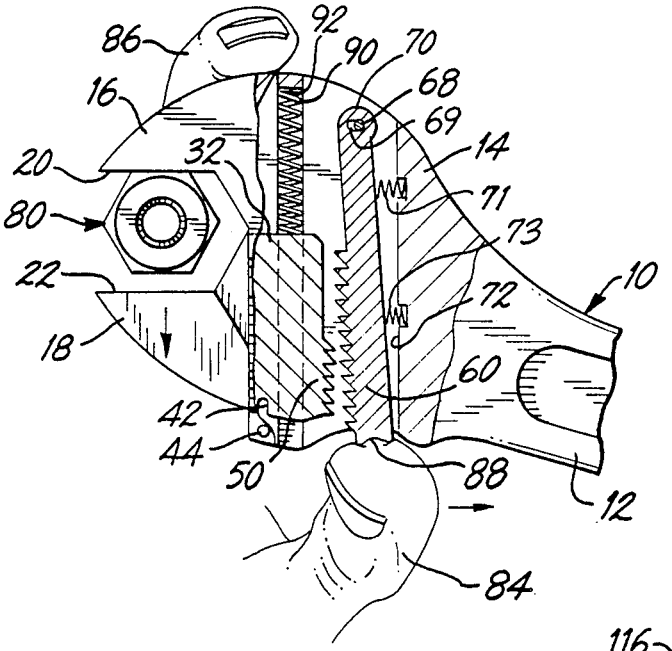
FIG. 5 is a view similar to FIG. 4, but with the component parts being released from the fastener element.

When it is desired to release jaw 18 from the adjusted position, as shown in FIG. 4, the operator need merely push his thumb 84 against an actuator member in the form of a finger grip 88 which projects from pawl 60 to move pawl 60 in a rearward direction, to the right as viewed in FIG. 5, thereby releasing pawl teeth 62 from ratchet teeth 52. The downward biasing force of a helical spring 90 is then free to drive jaw 18 downwardly toward the fully-open position where jaw 18 is halted by the engagement of the upper end of slot 42 with pin 44 (as seen in FIG. 2). Helical spring 90 extends between the uppermost end of tongue 32 and a retaining shoulder 92 placed within wrenching head 14 to secure helical spring 90 in place. Thus, jaw 18 easily is engaged with nut 80 and is released quickly.

The arrangement which includes helical spring 90 not only provides increased ease of operation, enabling one-hand manipulations for both adjustment and release, but attains accuracy in maintaining a selected adjustment in a more positive fashion. Thus, during adjustment, the biasing force of spring 90 urges the complementary ratchet teeth 52 and pawl teeth 62 into a secure and positive engagement, firmly locating jaw 18 relative to jaw 16. The adjustment of jaw 18 to a particular location is repeatable, with great accuracy, enabling the position of jaw 18 to be calibrated, if desired. To this end, a scale 94 of wrenching sizes may be displayed on the wrenching head 14, as seen in FIG. 1, and an index mark 96 will indicate the wrenching dimension set between the wrenching faces 20 and 22. The dimensions of the ratchet teeth 52 and the pawl teeth 62 are chosen accordingly; that is, the increments of movement enabled by the pawl and ratchet arrangement correspond to increments in the dimensions of the various elements to be wrenched.

Ease of operation, as well as strength and accuracy, is enchanced by the action of pivot pin 68 in laterally elongate slot 69 and the upper and lower helical springs 71 and 73. As best seen in FIG. 4, as jaw 18 is moved upwardly into the desired adjusted position, pawl 60 actually is displaced laterally rearwardly so that all of the pawl teeth 62 are moved readily out of the path of ratchet teeth 52 with no tendency to jam or become more difficult to move as jaw 18 traverses upwardly. Thus, slot 69 enables lateral movement of the upper end 70 of pawl 60 relative to pin 68 to accommodate rearward lateral movement of pawl 60, as well as pivotal movement of the pawl 60 about pin 68, to enable the desired ease of operation and accuracy. As seen in FIG. 4, all of the ratchet teeth 52 are riding over the pawl teeth 62 just before the selected position of jaw 18 is reached. Once that position is reached, lateral forward movement of pawl 60 enables all of the ratchet teeth 52 to be engaged fully by corresponding pawl teeth 62, as seen in FIG. 2, for greater strength in the coupling between pawl 60 and ratchet 50. The greater strength coupling enables the application of increased wrenching forces without failure of the pawl and ratchet connection.

Release of the pawl 60 from ratchet 50 is eased by the ability of pawl 60 to pivot about pin 68. Thus, as seen in FIG. 5, release is attained merely by pushing rearwardly against finger grip 88 to pivot pawl 60 and move the pawl 60 rearwardly, as described above.

Inadvertent release of the pawl 60 from ratchet 50 is avoided by enclosing the pawl 60 essentially entirely within cavity 58, by virtue of side walls 59. Finger grip 88 is placed within a small recess 102 in wrenching head 14 so that the release mechanism provided by the pawl 60 does not project beyond the normal continuation of the profile contour of the wrenching head 14, as illustrated in phantom at 104, in FIGS. 1 and 2. In this manner, wrenching movements of the wrenching head 14 can be accomplished without movement of pawl 60 by inadvertent engagement with a surrounding structure, while finger grip 88 is accessible from outside of cavity 58 for deliberate selective movement to move pawl 60 for selective release of pawl 60 from ratchet 50.

Figure 6:
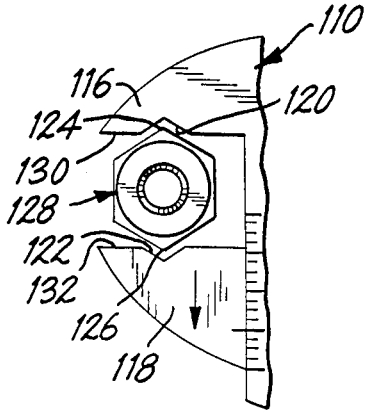
FIG. 6 is a view similar to FIG. 5, but illustrating an alternate embodiment.

In the embodiment illustrated in FIGS. 1 through 5, wrench 10 is provided with flat wrenching faces 20 and 22 for engaging corresponding flat wrenching surfaces on a fastener element. However, the construction of wrench 10 lends itself advantageously to the use of other configurations at the wrenching faces. For example, as illustrated in FIG. 6, another embodiment in the form of wrench 110 is provided with jaws 116 and 118 having wrenching configurations which include V-shaped notches 120 and 122 for engaging the apices 124 and 126 of a fastener element 128. Where wrenching clearance is limited, to the extent that wrench 110 can be engaged or disengaged with fastener element 128 only by sliding the wrench onto the fastener element in a direction parallel to the plane of the paper, it may be necessary to move jaw 118 through large enough displacements to clear apices 124 and 126 during engagement and disengagement of the wrench with the fastener element. In such a situation, the ease of advancement and retraction of jaw 118 along its sliding path enables rapid and accurate accommodation to the restricted conditions. Since wrench 110 also includes flat portions 130 and 132 along jaws 116 and 118, as well as notches 120 and 122, wrench 110 alternately can engage opposed apices and then opposed flats on the fastener element 128 to enable smaller increments of wrenching displacement under restricted turning conditions. Additionally, jaws 116 and 118 may be provided with any one of a variety of configurations to accommodate the particular wrenching configuration of the fastener element to be wrenched, enabling wrench 110 to operate in a manner similar to that of a box wrench, while exhibiting the quick-adjustment, quick-release features of the present invention.

It is apparent that the present invention provides an adjustable wrench arrangement which exhibits versatility and ease of use, together with accuracy and rugged construction. The arrangement requires a minimum number of component parts of limited complexity, rendering the wrenches economical to manufacture.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A wrench having a wrenching configuration adjustable to match a wrenching dimension of any selected one of a variety of fastener elements having wrenching configurations of different wrenching dimensions, said wrench comprising:

A wrenching head;

opposed jaws on the wrenching head and having wrenching faces, at least one of said opposed jaws being mounted upon the wrenching head for sliding movement toward and away from another of the opposed jaws for respectively decreasing an increasing the spacing between the wrenching faces of the opposed jaws;

biasing means continuously biasing the one said jaw in the direction away from the other said jaw;

locking means carried by the wrenching head for locking the one said jaw against the bias of the biasing means upon movement of the one said jaw in the direction toward the other said jaw to match the spacing between said wrenching faces with one of said different wrenching dimensions, the locking means including a ratchet carried by the one said jaw and having a plurality of ratchet teeth, a pawl, pawl mounting means mounting the pawl in the wrenching head for movement confined to lateral and pivotal movement relative to the ratchet and having a plurality of pawl teeth complementary to the ratchet teeth such that the pawl teeth and the ratchet teeth define fixed increments of spacing between the wrenching faces said, said lateral and pivotal movement of the pawl being in directions essentially normal to the direction of the sliding movement of said one of the opposed jaws so as to be toward and away from the ratchet for corresponding engagement and release of the pawl from the ratchet, and pawl biasing means biasing the pawl teeth laterally into full engagement with at least some of the ratchet teeth; and release means on the wrenching head for selectively releasing the locking means, the release means including an actuator member selectively movable to move the pawl laterally and pivotally against the bias of the pawl biasing means and selectively release the pawl teeth from engagement with the ratchet teeth to permit movement of the one said jaw in the direction away from the other said jaw in response to the biasing means.

2. The invention of claim 1 wherein the pawl includes opposite ends, the pawl teeth are located adjacent one of the opposite ends of the pawl, and the pawl mounting means is located adjacent the other of the opposite ends of the pawl, the pawl mounting means including a pin and a laterally elongate slot within which the pin is received to enable relative movement between the pin and the slot confined to pivotal movement of the pawl about the pin and lateral movement of the pawl by virtue of relative movement between the pin and the slot.

3. The invention of claim 2 wherein the pawl biasing means includes a first spring urged against the pawl adjacent the one of the opposite ends of the pawl to bias the pawl toward the ratchet, and a second spring urged against the pawl adjacent the other of the opposite ends of the pawl to bias the pawl toward the ratchet

4. The invention of claim 1 including stop means for limiting movement of the one said jaw away from the other said beyond a fixed maximum spacing between the wrenching faces.

5. The invention of claim 1 wherein the actuator member includes a finger grip integral with the pawl.

6. The invention of claim 1 including a flat portion extending along each of the wrenching faces, the flat portions of the respective wrenching faces being parallel to one another and complementary to corresponding portions of the particular wrenching configuration of the fastener element to be wrenched, and a recess in each of the wrenching faces, adjacent a corresponding flat portion, the recesses being complementary to further corresponding portions of the particular wrenching configuration of the fastener element to be wrenched whereby the wrenching faces selectively are engageable alternately with the particular wrenching configuration of the fastener elemen to be wrenched along either the flat portions or the recesses.

7. The invention is claim 6 including stop means for limiting movement of the one said jaw away from the other said jaw beyond a fixed maximum spacing between the wrenching faces.

8. The invention of claim 6 wherein the actuator member includes a finger grip integral with the pawl.

9. A wrench having a wrenching configuration adjsustable to match a wrenching dimension of any selected one of a variety of fastener elements having wrenching configurations of different wrenching dimensions, said wrench comprising:

a wrench head having a cavity therein and opposite side walls, the cavity including opposite sides and a rear wall extending transverse to the opposite sides of the cavity, and the opposite side walls enclosing the opposite sides of the cavity;

opposed jaws on the wrenching head opposite the rear wall of the cavity and having wrenching faces, at least one of said opposed jaws being mounted upon the wrenching head for sliding movement toward and away from another of the opposed jaws for respectively decreasing and increasing the spacing between the wrenching faces of the opposed jaws;

biasing means continuously biasing the one said jaw in the direction away from the other said jaw;

locking means carried by the wrenching head for looking one said jaw against the bias of the biasing means upon movement of the one said jaw in the direction toward the other said jaw to match the spacing between said wrenching faces with one of said different wrenching dimensions, the locking means including a ratchet carried by the one said jaw and having a plurality of ratchet teeth lying within the cavity in the wrenching head and enclosed between said opposite side walls thereof, a pawl within the cavity in the wrenching head and enclosed between said opposite side walls thereof, pawl mounting means monting the pawl in the wrenching head for movement confined to lateral and pivotal movement relative to the ratchet and having a plurality of pawl teeth complementary to the ratchet teeth such that the pawl teeth and the ratchet teeth define fixed increments of spacing between the wrenching faces, said lateral and pivotal movement of the pawl being in directions essentially normal to the direction of the sliding movement of said one of the opposed jaws so as to be toward and away from the ratchet for corresponding engagement and release of the pawl from the ratchet, and pawl biasing means biasing the pawl teeth laterally into full engagement with at least some of the ratchet teeth; and release means on the wrenching head for selectivey releasing the locking means, the release means including an actuator member accessible from outside of the cavity for deliberate selective movement to move the pawl laterally and pivotally against the bias of the pawl biasing means and selectively release the pawl teeth from engagement with the ratchet teeth to permit movement of the one said jaw in the direction away from the other said jaw in response to the biasing means.

10. The invention of claim 9 wherein the pawl includes opposite ends, the pawl teeth are located adjacent one of the opposite ends of the pawl, and the pawl mounting means is located adjacent the other of the opposite, ends of the pawl, the pawl mounting means including a pin and a laterally elongate slot within which the pin is received to enable relative movement between the pin and the slot for pivotal movement of the pawl about the pin and lateral movement of the pawl by virtue of relative movement between the pin and slot.

11. The invention of claim 10 wherein the pawl biasing means includes a first spring urged against the pawl adjacent the one of the opposite ends of the pawl to bias the pawl toward the ratchet, and a second spring urged against the pawl adjacent the other of the opposite ends of the pawl to bias the pawl toward the ratchet.

12. The invention of claim 11 including stop means for limiting movement of the one said jaw away from the other said jaw beyond a fixed maximum spacing between the wrenching faces.

13. The invention of claim 11 wherein the actuator member includes a finger grip integral with the pawl.

14. The invention of claim 11 including a flat portion extending along each of the wrenching faces, the flat portions of the respective wrenching faces being parallel to one another and complementary to corresponding portions of the particular wrenching configuration of the fastener element to be wrenched, and a recess in each of the wrenching faces, adjacent a corresponding flat portion, the recesses being complementary to further corresponding portions of the particular wrenching configuration of the fastener element to be wrenched whereby the wrenching faces selectively are engageable alternately with the particular wrenching configuration of the fastener element to be wrenched along either the flat portions or the recesses.

* * * * *